US006913215B2

(12) United States Patent
Gildersleeve et al.

(10) Patent No.: US 6,913,215 B2
(45) Date of Patent: Jul. 5, 2005

(54) METHOD AND APPARATUS FOR TUMBLING CONCRETE PRODUCTS

(75) Inventors: Stacy L. Gildersleeve, Vancouver, WA (US); Tomas A. Glascoe, Vancouver, WA (US)

(73) Assignee: Columbia Machine, Inc., Vancouver, WA (US)

( * ) Notice: Subject to any disclaimer, the term of this patent is extended or adjusted under 35 U.S.C. 154(b) by 212 days.

(21) Appl. No.: 10/269,377

(22) Filed: Oct. 10, 2002

(65) Prior Publication Data

US 2004/0069882 A1 Apr. 15, 2004

(51) Int. Cl.[7] ..... B02C 17/14
(52) U.S. Cl. ..... 241/182; 220/495.01
(58) Field of Search ..... 241/179, 182, 241/183; 220/495.01; 366/56, 57, 62

(56) References Cited

U.S. PATENT DOCUMENTS 3,981,117 A * 9/1976 Dehlen ..... 52/509
4,655,602 A * 4/1987 Tomlinson ..... 366/56
5,302,017 A * 4/1994 Platek et al. ..... 366/57
5,716,013 A 2/1998 Benson et al.
5,839,490 A * 11/1998 Kiedaisch et al. ..... 144/208.9
5,942,181 A 8/1999 Rondeau
6,109,906 A 8/2000 Castonguay et al.
6,390,401 B1 * 5/2002 Sellars ..... 241/299

* cited by examiner

*Primary Examiner*—Ed Tolan
(74) *Attorney, Agent, or Firm*—Marger Johnson & McCollom, P.C.

(57) ABSTRACT

A tumbler for tumbling concrete products comprises a rotatable cylindrical drum having an input end that is slightly elevated relative to an output end. Tire retread strips are placed side-by-side on the radially inner surface of the drum and extend along its length. Clamps having lateral arms extending on either side are engaged with lateral tread grooves on the strips. The clamps are bolted to the drum between adjacent strips thereby securing the strips to the radially inner surface of the drum.

5 Claims, 4 Drawing Sheets

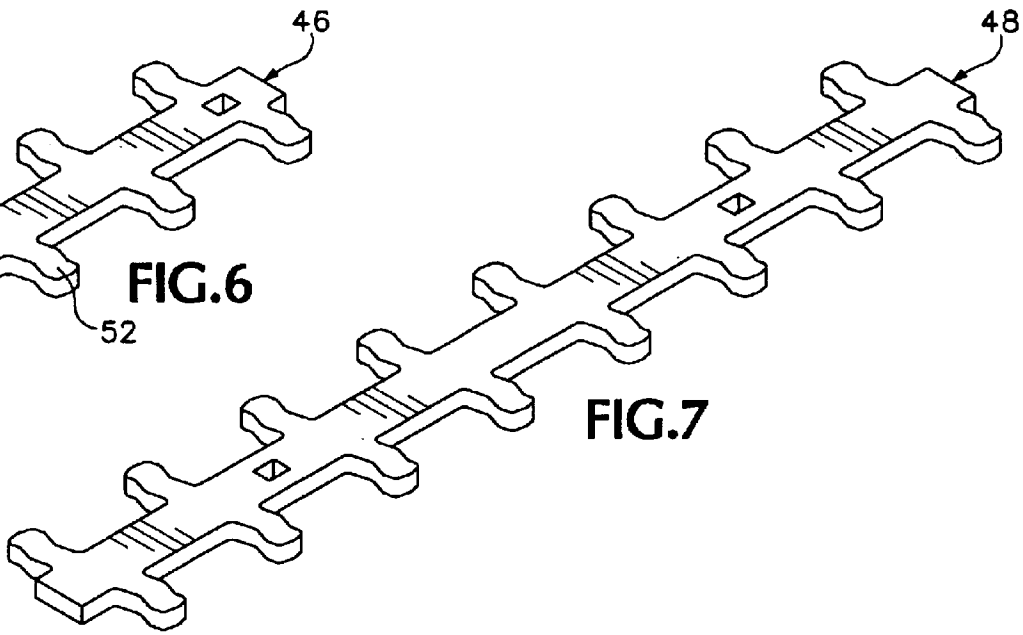
FIG.7
FIG.6
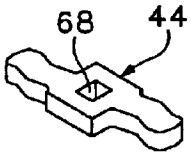
FIG.5
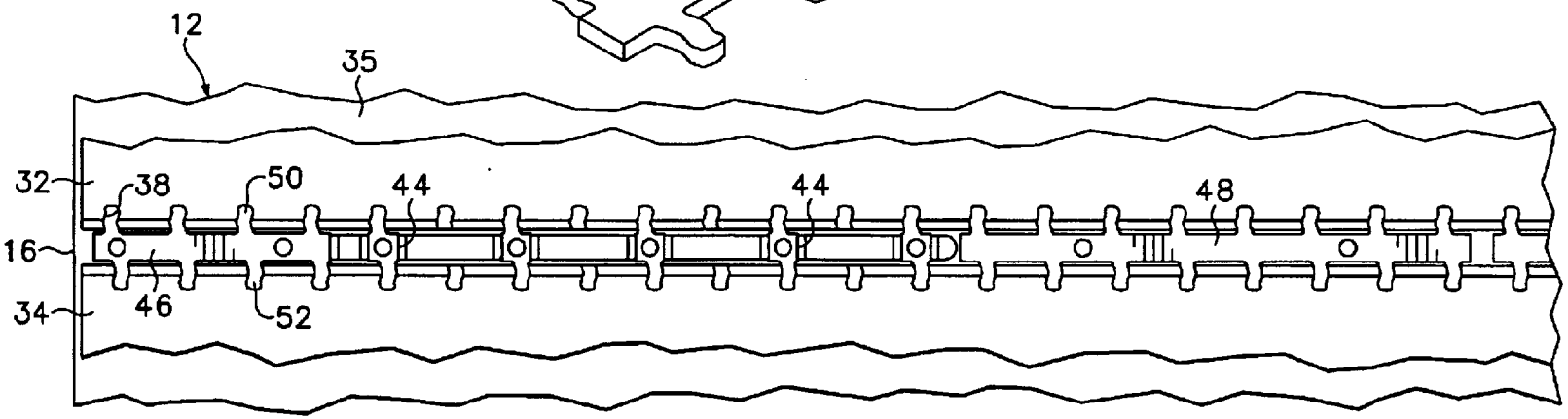
FIG.8

METHOD AND APPARATUS FOR TUMBLING CONCRETE PRODUCTS

BACKGROUND OF THE INVENTION

1. Field of the Invention

The present invention relates to methods and apparatus for tumbling concrete products and more particularly to such methods and apparatus in which concrete products are tumbled in a drum having an elastic liner.

2. Background of the Invention

It is known to provide a textured surface for concrete products, such as concrete blocks, by putting the blocks in a cylindrical drum having an elastic liner and rotating the drum. This chips the surface and provides a desirable textured appearance. The drum typically includes an input end that is elevated slightly relative to an output end. As a result, the blocks move toward the lower output end of the drum where they emerge, ready for shipping. While moving down the drum, the blocks tumble against one another, thus chipping the blocks.

The elastic liner is a suitable elastic material such as rubber. In one prior art tumbler, coaxial ribs, each including a cylindrical inner surface, are positioned adjacent one another along the length of the drum. A rubber strip is bolted to and covers each rib. The bolts are received through holes bored in the rubber and corresponding bores in the ribs. When the rubber is worn out, the bolts are removed, bores are drilled in new rubber strips, and the new rubber strips are bolted onto the ribs.

In another prior art drum, tire retread strips are placed on the radially inner drum surface parallel to the longitudinal axis. The strips are secured to the drum by bolts received in bores drilled through the strips and corresponding drum bores. As in the other prior art tumbler, when the tire retread strips are worn out, they are unbolted and bores are drilled into new retread strips in alignment with the mounting bores in the drum. The new strips are then bolted to the drum.

These prior art tumblers suffer from several disadvantages. First, there are many bolts that must be dealt with individually both in removing the worn strips and when installing new strips. Second, it is necessary to drill bores in the new rubber strips to accommodate the bolts that secure them. Drilling rubber is difficult and time-consuming. Finally, in these prior art tumblers, the head of each bolt is fully exposed above the surface of the rubber. As a result, the tumbling blocks frequently strike bolt heads, which tends to knock off the galvanizing.

BRIEF DESCRIPTION OF THE DRAWINGS

FIGS. 5, 6 and 7 depict short, medium, and long clamps used to clamp tire tread to the radially inner surface of the tumbler drum.

FIG. 8 is a view of the output end of the radially inner surface of the tumbler with portions of tire tread and tumbler drum broken away.

DETAILED DESCRIPTION OF THE PREFERRED EMBODIMENT

Figure 1:
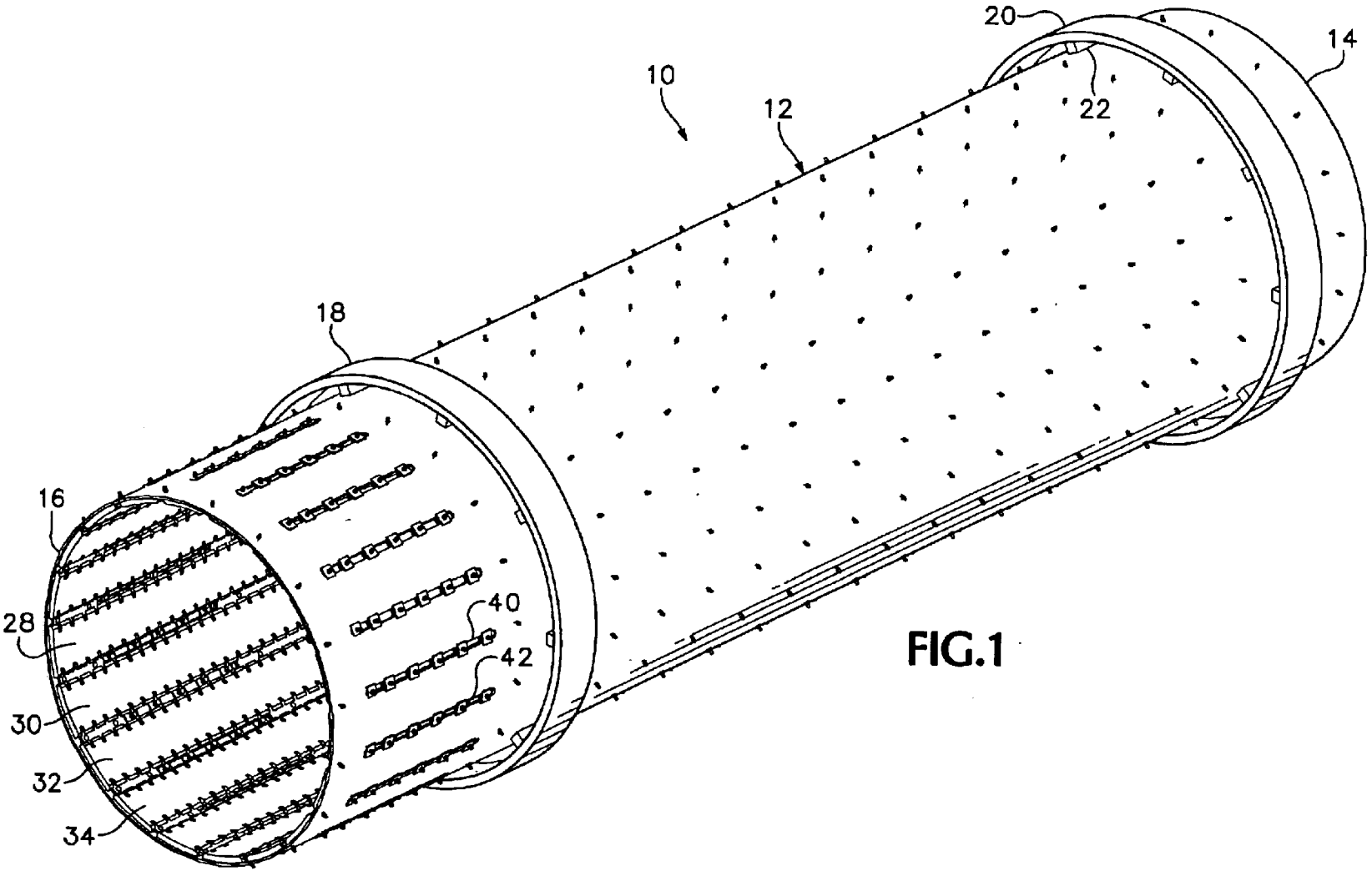
FIG. 1 is a perspective view of a portion of a tumbler constructed in accordance with the present invention.

Turning to FIG. 1, indicated generally at 10, is a tumbler for tumbling concrete products constructed in accordance with the present invention. Tumbler 10 includes a cylindrical metal drum 12 having an input end 14 and an output end 16.

A pair of roller rings 18, 20 are mounted on drum 12 coaxially therewith. The rings are mounted on ring support elements, like roller ring 20 is mounted on element 22 in FIG. 1. Elements 24, 26, upon which ring 18 is mounted, are viewable in FIG. 4.

Roller rings 18, 20 are supported by conventional drive wheels (not shown) on a conventional drive mechanism for rotating drum 12, as will later be more fully described in connection with the operation of tumbler 10.

Tire-tread strips, four of which are strips 28, 30, 32, 34, are mounted on the radially inner surface 35 of drum 12. These strips are also referred to herein as elastic strips. Strips 28, 30, 32, 34 are also visible in FIG. 2. These strips are commercially available and are used to retread tires. But the product is usually not in lengths as long as drum 12, which is approximately 20 feet. The suppliers of these strips, however, can provide custom lengths by vulcanizing pieces together. As a result, in the present embodiment of the invention, each strip extends along the entire length of drum 12.

Figure 2:
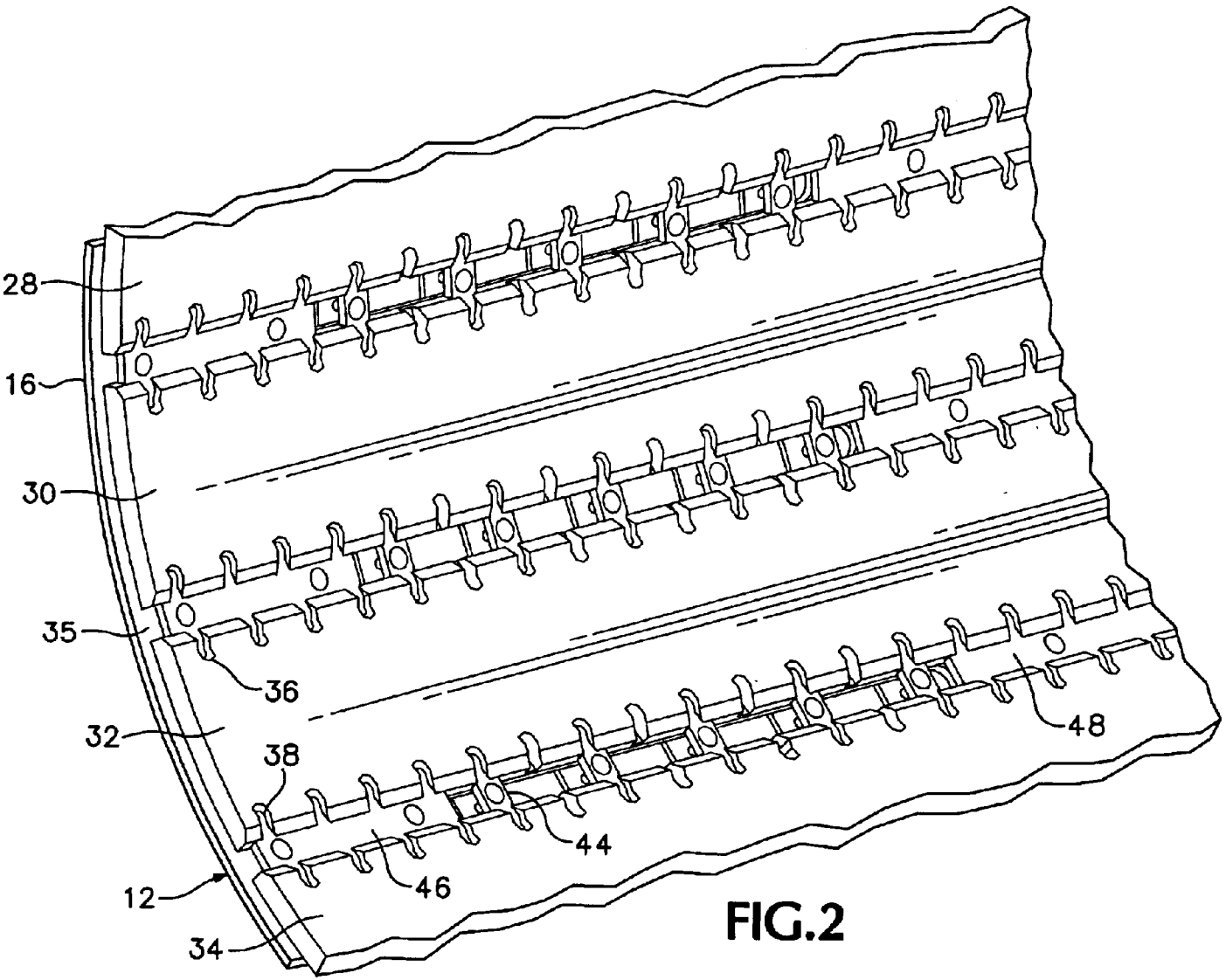
FIG. 2 is an enlarged partial view of an inner surface of the output end of the tumbler of FIG. 1.

The tire tread strips, like strip 32 in FIG. 2, include lateral tread grooves, like grooves 36, 38. As can be seen in FIG. 2, these grooves are longitudinally offset one from the other, i.e., they are not directly opposite one another. Although each of the strips, like strip 32, includes circumferential grooves, these are not shown for the sake of clarity in the drawings.

Turning again back to FIG. 1, longitudinal debris slots, like slots 40, 42 are formed adjacent output end 16 of drum 12. These slots are parallel to the longitudinal drum axis and are evenly spaced about the circumference of the drum as shown in the preferred embodiment.

Strips 28, 30, 32, 34 are secured to drum 12 via clamps, which are of three different sizes: small, like clamp 44 in FIG. 2; medium, like clamp 46 in FIG. 2; and large, like clamp 48, which is partially broken away in the FIG. 2 view. These clamps are each illustrated in FIGS. 5, 6, and 7, respectively, and are also depicted in FIG. 8. As can be seen in FIGS. 5–7, each of the clamps has lateral arms or lugs, like lugs 50, 52, on clamp 46, that extend from a central clamp body. As can be seen in FIG. 8, these lugs are laterally offset in the same fashion as lateral tire grooves, like grooves 36, 38 on tread 32 in FIG. 2. As a result, the ends of each tread strip, like the leftmost end of strips 32, 34 in FIG. 8, can be placed adjacent one end of the drum, and the offset lugs in each of the clamps can be received within lateral tread grooves on adjacent tire strips.

Figure 3:
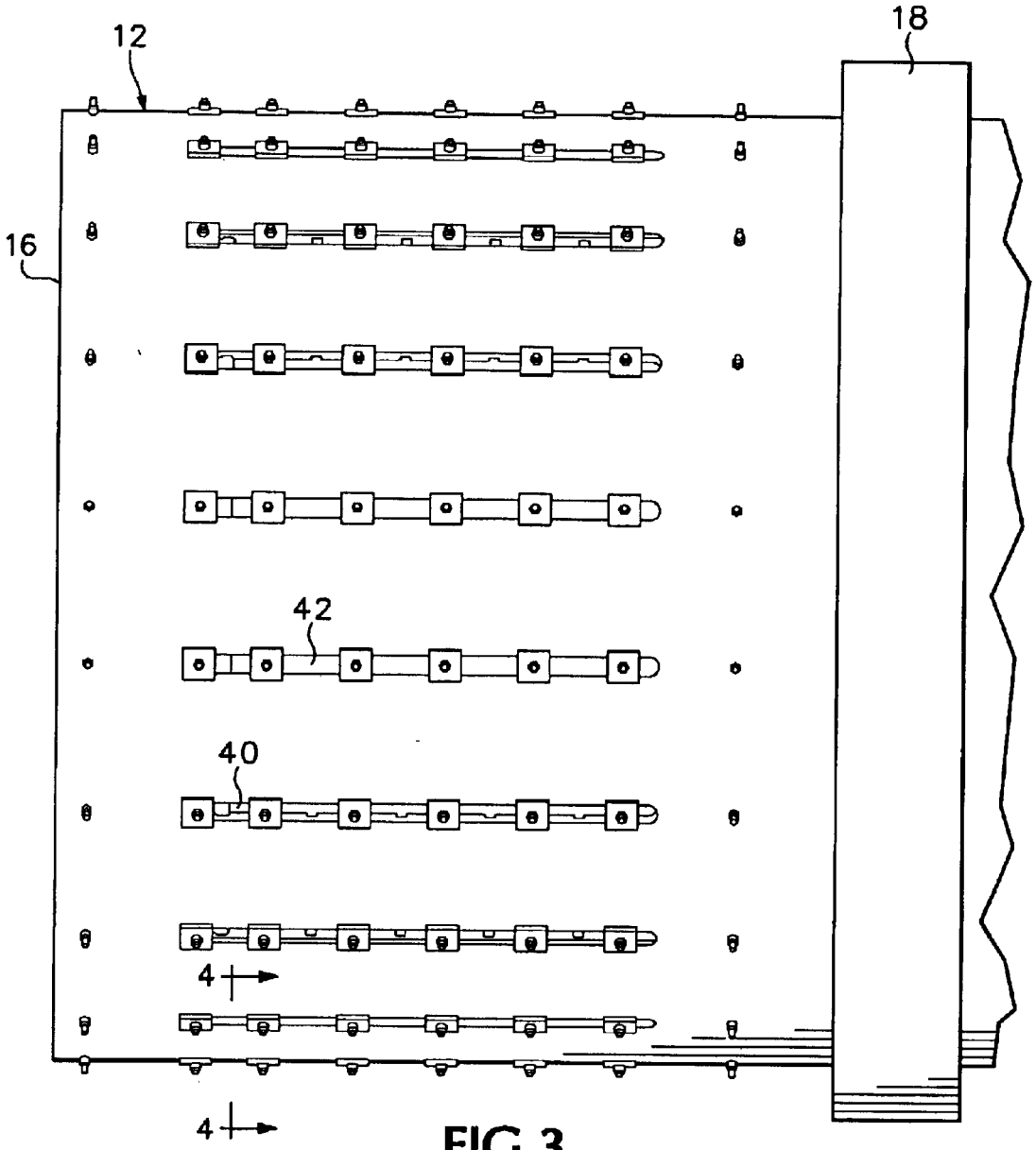
FIG. 3 is a side elevation view of the output end of the tumbler of FIG. 1.
Figure 4:
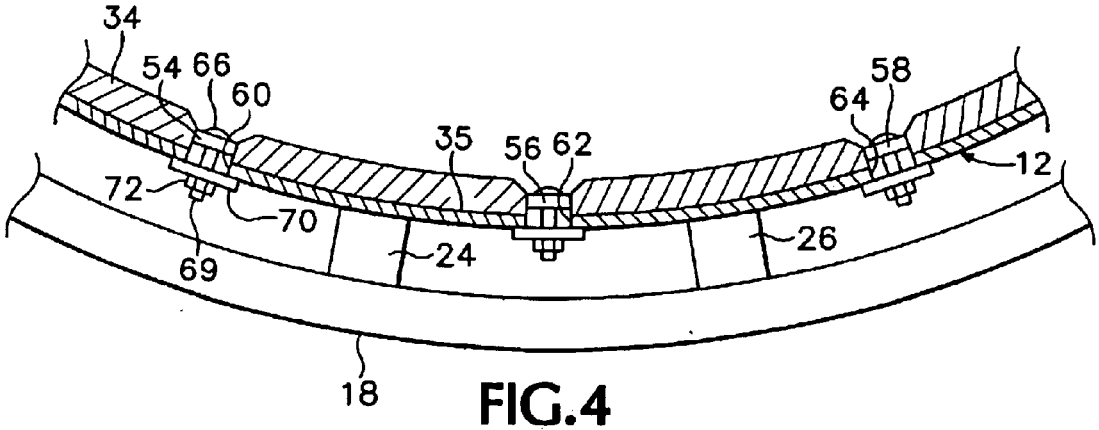
FIG. 4 is an enlarged partial cross-sectional view taken along line 4—4 in FIG. 3.

These clamps are secured as shown in FIGS. 3 and 4. First, with reference to the small clamps, like clamp 44, small clamps 54, 56, 58 have their lateral lugs (not visible in FIG. 4) received within lateral tire grooves in the same fashion that the lugs on clamp 44 in FIG. 8 are so received. These small clamps are used to secure tire tread edges that are adjacent the slots, like slots 40, 42 in FIG. 3. For example, small clamps 54, 56, 58 are associated with slots 60, 62, 64, respectively, in FIG. 4. A commercially available bolt, like bolt 66 associated with clamp 54, secures each of the small clamps to drum 12. Bolt 66 is of the type having a square cross-section that extends from beneath the flat underside of the bolt head. This square cross-section is obscured because it is received within a square opening, like opening 68 in clamp 44 (FIG. 5). The bolt is therefore secured against rotation in opening 68.

A threaded lower end 69 of bolt 66, in FIG. 4, is received through slot 60. A square washer 70 is received over threaded bolt end 69 and a nylon nut 72 is threadably engaged with bolt end 69 and tightened. As a result, the arms on clamp 54 are pulled well into the lateral tire grooves, like grooves 36, 38 in FIG. 2. These arms clamp the adjacent tread strips firmly against the radially inner surface 35 of drum 12 thereby securing them in place.

Each of the other clamps secure adjacent treads in a similar fashion. The other clamps, namely the medium and large clamps, however, are not mounted adjacent the slots, like slots 40, 42. Although these medium and large clamps are secured using bolts, like bolt 66, the bolts are received through an unthreaded bore through drum 12. A plurality bolt ends are seen extending through these bores in drum 12 from between the debris slots, like slots 40, 42 in FIG. 1 to input end 14 of the drum. In the present embodiment of the invention, large clamps, like clamp 48, are placed end to end between input end 14 and the debris slots and are bolted into position using the bolts as shown. For the large clamps, it is not necessary to provide a washer between the nylon nut and the radially outer surface of drum 12. Rather, the nut is simply tightened against the surface of the drum.

A single medium clamp is used between each debris slot and output end 16 of the drum. As can be seen in FIG. 3, the end of each medium clamp toward the debris slot is secured at one end of the debris slot using a square washer in the same fashion as each of the small clamps are secured in the slot. The end of the medium clamp toward output end 16, however, is secured like each of the large clamps, i.e., with the bolt received in a bore and without a washer between the nylon nut and the radially outer surface of the drum.

This configuration leaves openings between each of the small clamps through which debris falls as the drum rotates and the product is tumbled.

When the tire treads become worn out, the clamps are unbolted and the worn treads removed. New treads are then positioned inside the drum and the clamps re-attached as shown in the drawings. This system provides several advantages. Among these are use of fewer bolted connections than prior art tumblers, no drilling of rubber, and more protection for each of the bolt heads and the associated clamps. This protection results from placing the bolt heads and clamps beneath the radially innermost surface of each of the tire strips (shown in FIG. 4), as opposed to mounting a bolt or clamp on the surface of the tire strip. As a result, tumbling concrete products may from time to time land on the bolt heads and clamps. But the bolt heads and clamps are somewhat protected because they are received between adjacent tire strips and pulled down beneath the upper surface of the tire strips, as shown in FIG. 4.

Having described and illustrated the principles of the invention in a preferred embodiment thereof, it should be apparent that the invention can be modified in arrangement and detail without departing from such principles. I claim all modifications and variation coming within the spirit and scope of the following claims.

What is claimed is:

1. A method for lining a drum comprising:

laying tire treads having lateral tread grooves on the inner drum surface adjacent one another;

providing a clamp having a first lug extending laterally from one side thereof and a second lug extending laterally from the other side thereof;

positioning the first lug within a first lateral groove on a first tire tread;

positioning the second lug within a second lateral groove on a second tire tread adjacent the first tire tread;

clamping the adjacent tire treads to the inner drum surface by compressing the tire tread between the lugs and the inner drum surface along the edge of each tire tread.

2. The method of claim 1 wherein said tire treads are oriented parallel to the longitudinal axis of the drum.

3. The method of claim 2 wherein said clamp further includes a third lug extending laterally from said one side of said clamp and a fourth lug extending from said other side of said clamp and wherein clamping the adjacent tire treads to the inner drum surface includes positioning the third lug within a third lateral groove on said tire tread and positioning the fourth lug within a fourth lateral groove on a second tire tread.

4. The method of claim 3 wherein said drum further includes a longitudinal slot and wherein clamping the adjacent tire treads to the inner drum surface further includes bolting the clamp to the drum via the slot.

5. The method of claim 4 wherein said clamp further includes additional lateral lugs extending from both sides of said clamp and wherein said method further includes positioning the additional lugs into additional lateral grooves on said first and second tire treads.

* * * * *

UNITED STATES PATENT AND TRADEMARK OFFICE

CERTIFICATE OF CORRECTION

PATENT NO. : 6,913,215 B2
DATED : July 5, 2005
INVENTOR(S) : Gildersleeve et al.

It is certified that error appears in the above-identified patent and that said Letters Patent is hereby corrected as shown below:

Title page,
Item [75], Inventors, "Tomas A. Glascoe" should read -- Thomas A. Glascoe --.

Column 4,
Line 35, "surface includes" should read -- surface further includes --.
Line 36, "said tire" should read -- said first tire --.
Line 37, "on a second" should read -- on said second --.

Signed and Sealed this

Twenty-seventh Day of September, 2005

JON W. DUDAS
*Director of the United States Patent and Trademark Office*